United States Patent [19]

Pirkle

[11] Patent Number: 4,846,707

[45] Date of Patent: Jul. 11, 1989

[54] ELECTRICAL OUTLET

[76] Inventor: Randall W. Pirkle, 13370 Rosedale Blvd., Carleton, Mich. 48117

[21] Appl. No.: 184,743

[22] Filed: Apr. 22, 1988

[51] Int. Cl.[4] ..... H01R 13/44

[52] U.S. Cl. ..... 439/142; 439/263

[58] Field of Search ..... 439/259–265, 439/597, 682, 136–138, 140, 142

[56] References Cited

U.S. PATENT DOCUMENTS

| | | | |
|---|---|---|---|
| 1,310,138 | 7/1919 | Sargent . | |
| 2,175,472 | 10/1939 | Kuhlman | 439/263 |
| 2,289,172 | 7/1942 | Beal | 439/263 |
| 2,710,382 | 6/1955 | Fitzpatrick et al. . | |
| 2,770,786 | 11/1956 | Czyzewski . | |
| 3,710,304 | 1/1973 | Warner et al. | 439/263 |
| 3,980,370 | 9/1976 | Gonzalez-Hernandez . | |
| 4,179,175 | 12/1979 | Farnworth et al. . | |
| 4,206,957 | 6/1980 | Ludwig et al. . | |
| 4,549,778 | 10/1985 | Price et al. . | |
| 4,600,258 | 7/1986 | Hu . | |
| 4,616,285 | 10/1986 | Sackett . | |

*Primary Examiner*—Gary F. Paumen

*Attorney, Agent, or Firm*—Dykema Gossett

[57] ABSTRACT

The present invention discloses a safety device which has a dual purpose, resisting the insertion of foreign objects or electrical plugs into the outlet without first moving an actuator arm and resisting removal of said plug once properly inserted without first moving the actuator arm. The outlet has at least one receptacle with opposed u-shaped contacts with the adjoining sides of said contacts having inclined surfaces thereon. The actuator arm is moveable along these inclined surfaces to open and close the contacts as needed. A blocking or shield member is pivotally mounted between the sides of each contact to further resist insertion of foreign objects or an electrical plug into the contact without first moving the actuator arm. In the preferred embodiment, the actuator arm includes a spring having a stiff bias which makes movement of the actuator arm difficult for small children. The invention is also disclosed in a further embodiment wherein it is used in an electrical extension cord application.

15 Claims, 3 Drawing Sheets

ELECTRICAL OUTLET

BACKGROUND OF THE INVENTION

The present invention relates to a safety outlet and more particularly to a dual function safety outlet to prevent children from sticking things into the outlet or partially pulling plugs from the outlet and being electrocuted.

As is well-known, electrical outlets are very intriguing to young children and invite investigation by children. Because of their location, and because of the exposed openings in an electric outlet, children are drawn to them and many times stick objects into the outlet. Children are also intrigued by the electrical plugs which are plugged into outlets. Again, because of their location, children may pull the plug partially out of the socket exposing the prongs which, if touched, may electrocute the child.

There have been many attempts to protect children from the dangers of electrical outlets. The prior attempts known to the Applicant generally fall into two broad categories, outlets that have a sliding member that normally blocks insertion of a plug or foreign object, and outlets having electrical contacts that are normally disconnected from the electrical power source requiring insertion of an electrical plug to complete the circuit between the main electrical source and the outlet contacts.

Examples of the first type of safety outlet are disclosed in the following U.S. Pat. Nos. 2,710,382; 2,770,786; 4,206,957; 4,549,778 and 4,600,258. Each of these Patents have some form of blocking member which must be shifted laterally to expose the electrical contacts of the electric outlet before an electrical plug can be inserted.

Examples of the second general type of safety outlets are found in U.S. Pat. Nos. 3,980,370; 4,179,175 and 4,616,285. Each of these safety outlets requires the insertion of an electric plug before electric current is supplied to the contact of the outlet. When the electric plug is absent, the supply of electricity to the outlet is interrupted so that insertion of foreign objects into the outlet will not result in electrocution.

SUMMARY OF THE INVENTION

The safety outlet of the present invention has two purposes, to prevent or at least make it extremely for small children to insert a plug or foreign object into an electrical outlet and to prevent removal of an inserted plug from the outlet.

Briefly, the outlet of the preferred embodiment has an actuating arm which must be manually moved to permit an electric plug to be inserted or removed from the outlet. The actuating arm is biased by a heavy spring which makes movement difficult for children. The exterior of the outlet looks similar to any standard electrical outlet except for the addition of actuating buttons which protrude through the cover-plate of the outlet. The actuating buttons are either integral with or interconnected to the actuating arm and must be depressed in order to move the actuating arm.

The preferred outlet includes at least one receptacle having a pair of spaced electrical outlets for receipt of the prongs of an electric plug. Each of the contacts is defined by a generally u-shaped electrically conductive member having elongated sides to receive a prong of the electric plug.

The adjoining sides of the two contacts have inclined surfaces which increase in height along the length of sides. The actuating arm is mounted between these inclined surfaces and is normally wedged between the high point of the inclined surfaces to close the open-ends of the u-shaped contacts. A spring is provided to bias the actuating arm between the inclined surfaces to this normally closed position. The actuating arm can be moved against the bias of this spring to the low point of the inclined surfaces to permit the free ends of the u-shaped contact to be opened for receipt of the prongs of the electric plug, or if a plug has been inserted, for removal of the plug.

A blocking member is pivotally mounted for pivotal movement between the sides of each u-shaped contact. Each blocking member is spring biased to a normal position blocking the opening in the receptacle. The blocking member is tightly held in the blocking position by the sides of the contact which are forced together by the actuating arm. As should be understood, the blocking members are free to pivot away from the opening of the receptacles when the actuating arm is moved to the low-point of the inclined surfaces.

As should be understood, the actuating arm must be moved before the blocking members can be pivoted out of the contact. To insure that the blocking members have been pivoted completely out of the contact so that they do not interfere with the contact between the prongs and the contacts and to insure a good connection, an elongated ridge is provided on the inner sides of the contact. This ridge prevents the blocking member from interfering with the contact between the plug and electrical contacts and facilitates the connection.

To use the outlet, an exterior push button is depressed which moves the actuator arm releasing the contacts. With the push button depressed, a plug can be inserted which pivots the blocking members below the elongated ridge. When the plug is fully inserted, the push button is released causing the actuator arm to again wedge between the inclined surfaces on the contacts forcing the contacts to grip the plug. This gripping action prevents or at least makes it difficult for the plug to be removed. To remove the plug, the push button is depressed releasing the grip on the prongs. As the plug is removed, the blocking members automatically pivot back to their normal position blocking the receptacle openings. When the plug is fully removed, the push button is released and the contacts tightly grip the blocking member.

In a further embodiment of the present invention, an extension cord receptacle employs the contacts, blocking member and actuator arm just described. In the electric cord receptacle, instead of having a push button actuator, a ring is employed having a centrally disposed actuator arm. The actuator arm fits within a slot formed in the body of the receptacle and is free to move along the length of the receptacle. The ring encircles the body portion. By moving the ring against the bias of a coil spring, the force on the contacts can be removed so that a plug can be inserted or removed.

Other advantages and meritorious features of the electrical outlet of the present invention will be more fully understood from the following description of the invention, the appended claims and the drawings, a brief description of which follows.

DETAILED DESCRIPTION OF THE INVENTION

Figure 1:
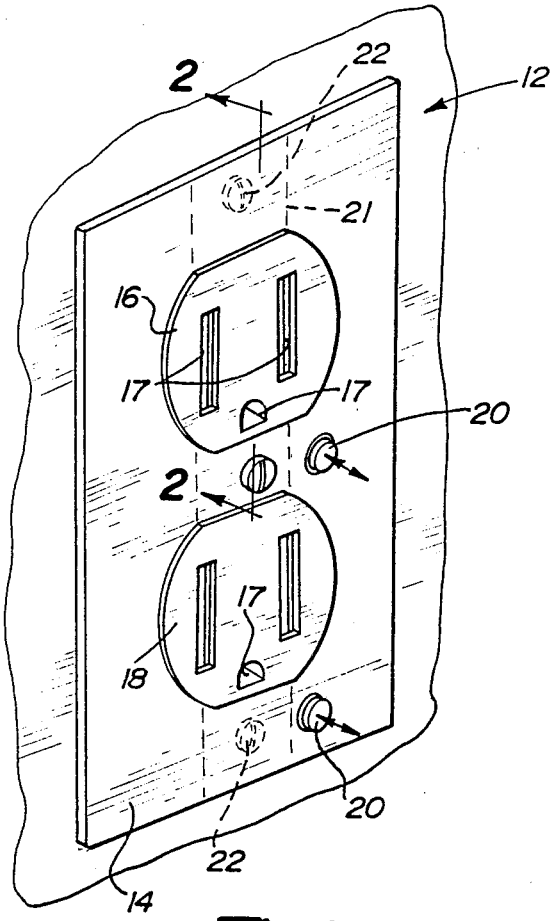
FIG. 1 is a perspective view of the safety device of the present invention as it would appear installed in a typical home.

With reference to FIG. 1, the safety outlet of the present invention is shown generally at 10. Outlet 10 is mounted within a wall 12 and includes a face-plate 14, upper and lower receptacles 16 and 18 each having openings 17 for receipt of a plug and push buttons 20. The face-plate 14 is a standard face-plate with the addition of openings for push buttons 20.

Figure 2:
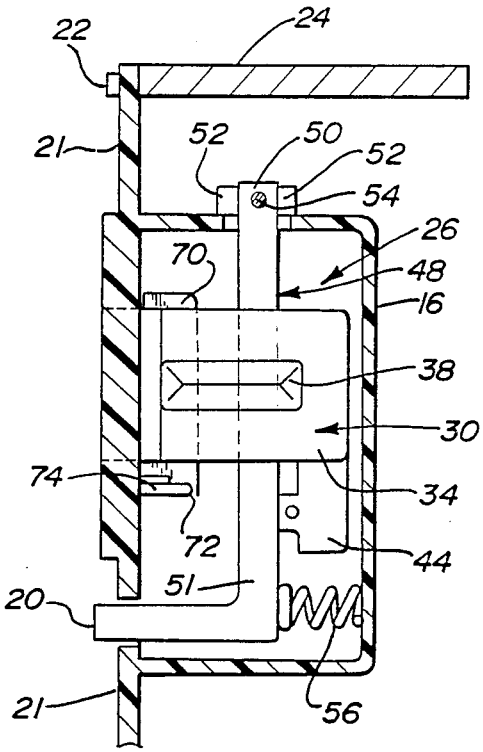
FIG. 2 is a cross-sectional view of FIG. 1 taken along line 2—2.
Figure 3:
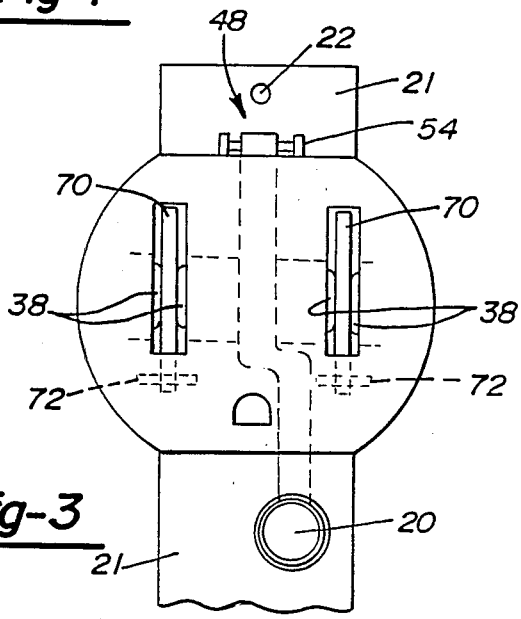
FIG. 3 is a partial frontal view of a receptacle of the present invention.
Figure 4:
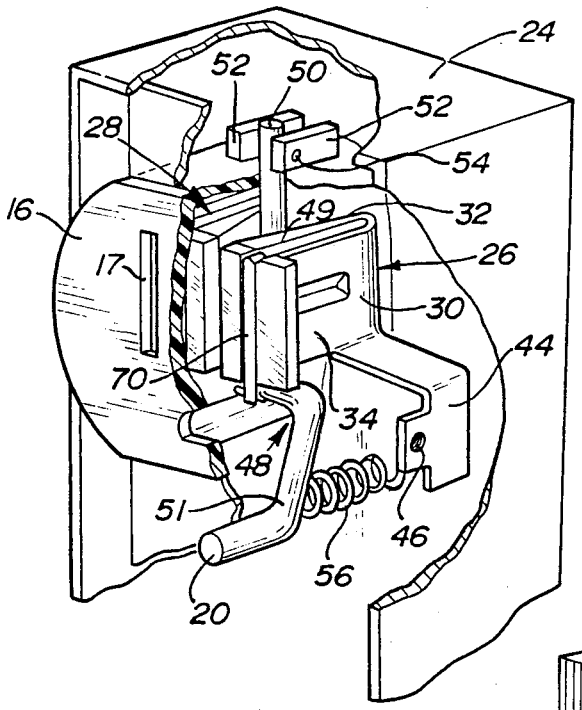
FIG. 4 is a partial cut-away perspective view of the present invention.

With reference to FIG. 2, a cut-away view of FIG. 4 is illustrated. In this view, the face-plate 14 has been removed. In the preferred embodiment, the upper and lower receptacles 16 and 18 are integrally formed and have a mounting bracket 21 at both ends for mounting the receptacles by screws 22 to an electrical box 24. With reference to FIG. 1, the integral formation of the receptacles and the mounting brackets 21 is shown by the dotted lines.

Figure 5:
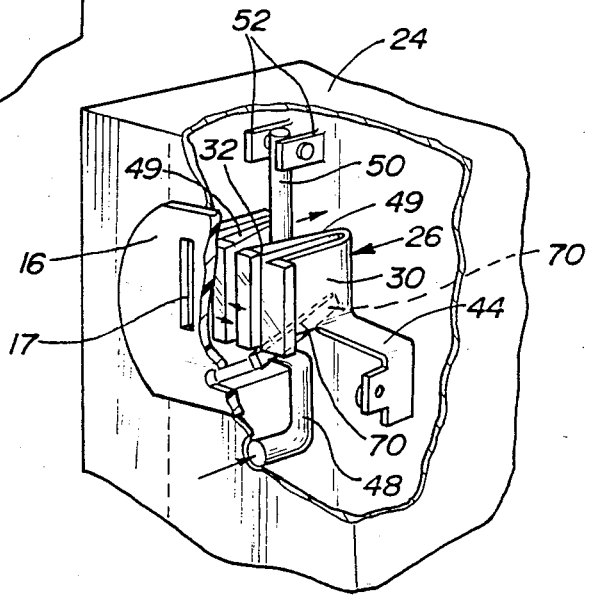
FIG. 5 is similar to FIG. 4 and illustrates the action of the actuator arm being moved to the low side of the inclined surfaces.

Each receptacle 16 includes spaced electrical contacts 26 and 28. See FIGS. 4, 5 and 6. The electrical contacts have a u-shaped body portion 30 with elongated sides 32 and 34. These sides form an opening for receipt of the prongs of an electric plug. Preferably, outer sides 34 of each contact 26 and 28 are molded into the body of receptacles 16 and 18 with the inner sides 32 being movable with respect to the outer side 34. Each of the sides 32 and 34 have insulators 40 and 42 at their free ends which insulate the openings. In this way, the plug or other object when inserted must at least pass beyond the insulators before any contact is made with the electric contacts.

Extending outwardly from each contact 26 and 28 is an electrical connecting means 44. This connecting means interconnects the electrical contacts 26 and 28 with an electrical power source. It should be understood, that any manner of connecting the electrical contacts to the power source within the scope of the present invention. The preferred embodiment includes a mounting screw 46.

Figure 6:
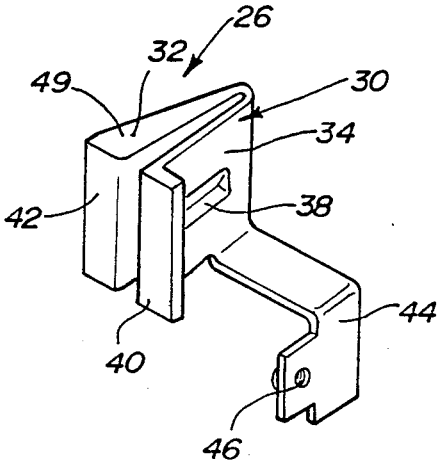
FIG. 6 is a perspective view of one contact of the present invention.

With particular reference to FIG. 6, an inclined surface 49 is integrally formed or mounted to the inner or adjoining sides 32 of each contact 26 and 28. The inclined surface 49 has its high-point at the open end of the contact and decreases to a low-point at the base of the u-shaped contacts. An actuator arm 48 is pivotally mounted between the inclined surfaces for movement along the length of the inclined surfaces. The actuating arm 48 has an upper end 50 pivotally mounted to bracket 52 at the top of receptacle 16 to pivot about an axis 54. A biasing means 56, such as a coil spring, is mounted to the lower end 51 of actuating arm 48 with arm 48 ending in push button 20. The biasing means 56 may also be formed by making actuating arm 48 resilient and fixing end 50 so that arm 48 actually moves by bending. It should be understood that other biasing means are considered by Applicant to be within the scope of this invention.

By depressing button 20, arm 48 is pivoted against the bias of spring 56 from a first position wherein arm 48 is wedged between the high point of the inclined surfaces 49 to a second position wherein arm 48 is at the low point of the inclined surfaces 49. In the first position, the wedging action of the actuator arm 48 against the inclined surfaces causes side 32 to move in the direction of side 34. Pivotally mounted between these sides is a blocking member or shield 70 which is free to pivot from a position adjacent the free end of the contacts 26, 28 to a position out of the insertion path of the plug when the plug is inserted. This can be seen in FIG. 5 where the shield 70 has been pivoted away from the opening in contact 26 after actuating arm 48 has been moved to the low end of the inclined surfaces. It should be understood that the shield 70 would be pivoted by the prongs as they are inserted. The shield 70 is pivotally mounted about an axis 72 which is fastened by a bracket 74 to the side or bottom wall of the receptacle 16. A coil spring (not shown) is mounted about axis 72 to bias shield 70 to the upright blocking position.

The sides 32 and 34 of each contact have elongated ridges 38 which extend into the plug path of the receptacle. In the preferred embodiment, the ridges are semi-circular in cross-section and have a knurled exterior to assist in gripping the prongs of the electric plug when the plug is inserted. Additionally, the ridges 38 ensure that the shields 70 are out of the path of the prongs when the prongs are inserted to prevent any interference between the contacts 26, 28 and the prongs of the plug. The semi-circular cross-section of the ridges forces the shield 70 out of the path of the plug when the shield is below the longitudinal center line of the ridges 38.

The safety outlet 10 of the present invention is designed so that it can replace standard outlets. In the preferred embodiment, the contacts 26 and 28 are molded within receptacles 16 with the middle of the receptacle being open at 62 to permit movement of actuating arm 48. The side 34 of each contact is molded into the receptacle body with the inner side 32 being moveable with respect to the fixed side 34. The electrical connecting member 44 extends out of the receptacle body for connecting to the electrical power source. Coil spring 56 abuts against the back of the receptacle housing. It should be understood, by incorporating all of the components of the present invention within a receptacle housing which can be easily inserted into a standard electrical box 24, the present invention is readily adaptable to standard housing electrical assemblies. This makes the present invention extremely versatile and adaptable to any domestic electrical system. All that is necessary for installation is to remove the present receptacle plugs and replace them with the present invention. The replacement would be a matter of attaching the electrical source to the connecting member 44 at 46 and attaching the receptacles to the electrical box by screws 22.

Figure 7:
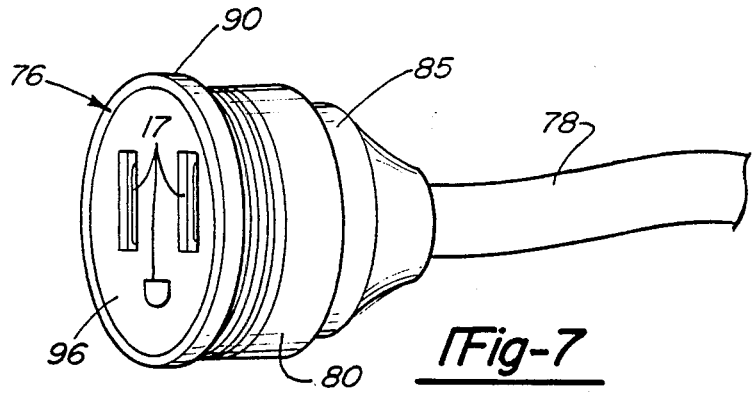
FIG. 7 is a perspective view of an electrical cord receptacle employing the present invention.
Figure 8:
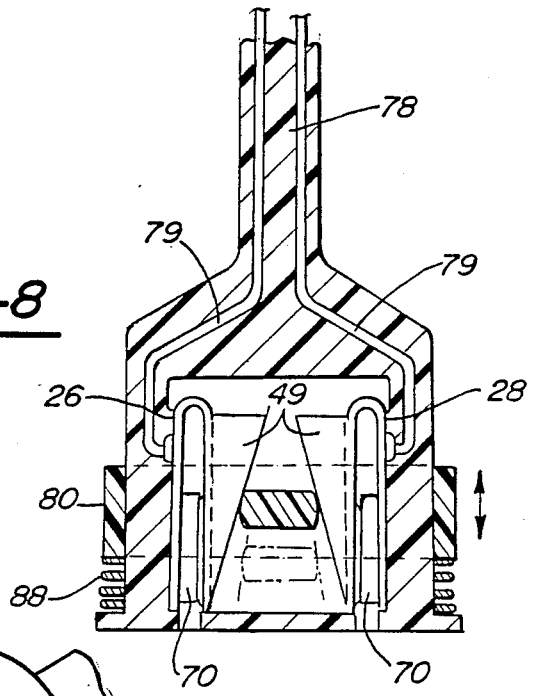
FIG. 8 is a cut-away view of FIG. 7 taken along line 8—8.
Figure 9:
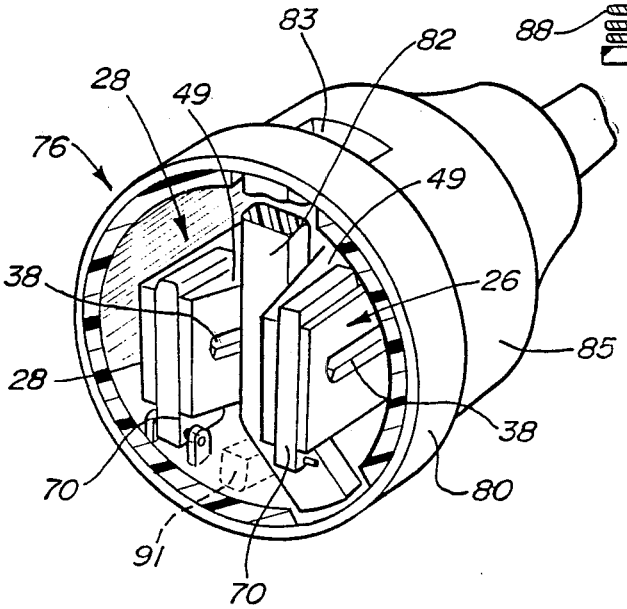
FIG. 9 is a partial perspective view of FIG. 7 taken along line 9—9.

With reference to FIGS. 7–9, a further embodiment of the present invention is illustrated. In this embodiment, the safety outlet is employed on an electrical extension cord with elements which are similar to previously discussed elements having the same numerical designation. In this embodiment, electrical contacts 26 and 28 are mounted within plug housing 86. The plug housing is similar to the receptacle housing 16 of the previous embodiment. As before, the outer sides 34 of contacts 26 and 28 are fixed to the interior of plug 86 with the inner sides 32 being moveable with respect to outer sides 34. An electric cord 78 is connected to the plug housing and it contains electrical leads 79 which are attached to contacts 26 and 28 in a conventional manner, such as by a screw or clip.

As before, shields 70 are pivotally mounted and spring biased to the blocking position and are held in place by the wedging action of the actuator arm 82 wedging between inclined surfaces 49.

In this embodiment, the actuator arm 82 is mounted within a control ring 80 and extends through a slot 83 formed in the body portion 85 of the plug receptacle 76. This control ring 80 is biased by a coil spring 88 to normally wedge the actuator arm 82 between the inclined surfaces closing the contact against the shield 70. It should be understood, that the location of the coil spring can either be about the outer diameter of the receptacle biased between an outer flange 90 and the control ring 80 or interior of the receptacle biased between the face-plate 92 of the receptacle and the actuator arm or the spring can be at both locations. As can be seen in FIGS. 8 and 9, the inclined surfaces incline in a direction opposite to the free ends of the contacts 26 and 28 which is opposite to the inclination in the previous embodiment. This direction of inclination is preferred because electrical extension cords typically are pulled along the ground when they are being used. Because of the orientation of the inclined surfaces, the actuator arm 82 is not released from its wedged position by pulling the cord but rather it is further wedged between the inclined surfaces to better grip the prongs of the plug inserted into the plug receptacle.

With reference to FIG. 9, the face-plate 92 has been removed to show the interior of the plug receptacle 76. In the preferred embodiment, the actuator post 82 is angled at its lower portion for clearance of the ground 91 of the plug receptacle 76. The actuator post 82 is free to slide within slot 83 formed in the body portion 85 of plug receptacle 76. In this way, a standard two or three prong electrical plug may be inserted into the electrical plug receptacle 76 of the present invention when the control ring 80 is pulled in the direction of the free end of contacts 26 and 28. This movement of control ring 80 moves actuating post 82 to the low side of the inclined surfaces permitting the prongs of the electrical plug to be inserted and simultaneously pivot the shields 70 clear of the contacts. As discussed above, ridges 38 are provided to ensure shields 70 have been properly cleared from the plug path. Upon insertion of the electrical plug prongs, the control ring is released and spring 88 biases the ring to a wedged position between the high sides of inclined surfaces 49 which causes the sides of contacts 26 and 24 to grip the prongs making removal of the electric plug difficult. To remove the plug the force on the contacts must be released by sliding control ring 80 in the forward direction.

While the preferred embodiments of the present invention have been described so as to enable ones skilled in the art to practice the techniques of the present invention, the preceding description is intended to be exemplary and should not be used to limit the scope of the invention. The scope of the invention should be determined only by reference to the following claims:

What is claimed:

1. An electrical outlet having a least one receptacle for receipt of an electrical plug, said outlet comprising:

a pair of spaced electrical contacts mounted within said receptacle, each of said contacts having opposed electrically conductive members flexibly connected and open at one end for receipt of a prong of said electrical plug;

control means operatively mounted adjacent said spaced electrical contacts normally biasing said one end of said conductive members together to close said contacts when said plug is not present to resist insertion of the prongs of said plug into said contacts and to bias said contacts against the prongs of said plug when inserted into said receptacle to resist removal of said plug, said control means having an actuator arm mounted between said spaced contacts, said arm being moveable between a first position wherein said contacts are urged to a closed position and a second position wherein said contacts are opened, said actuator arm being accessible from the exterior of said outlet, said actuator arm including biasing means to bias said arm to said first position such that said contacts are normally urged to said closed position, said biasing means having to be overcome to open said contacts.

2. The outlet of claim 1, wherein each of said spaced electrical contacts have facing said electrically conductive members with opposed inclined surfaces thereon;

said actuator arm being moveable between high and low points of said inclined surfaces, with said first position corresponding to said actuator being at said high point and said second position corresponding to said actuator being at said low point.

3. The outlet of claim 1, further including blocking means positioned between the electrically conductive members of each of said contacts, said blocking means being mounted for pivotal movement between a first position wherein said blocking means are adjacent said one end of said contacts to prevent insertion and a second position wherein said blocking means are pivoted away from said one end to permit insertion.

4. The outlet of claim 3, wherein said blocking means are normally biased to said first position.

5. The outlet of claim 3, wherein each of said electrically conductive members includes a longitudinally extending ridge for facilitating the pivoting of said blocking means away from said opening and to facilitate the biasing of said contacts against the prongs of said plug when inserted into said receptacle thereby resisting removal of said plug.

6. An electrical outlet having a least one receptacle for receipt of an electrical plug, said outlet comprising:

a pair of spaced electrical contacts mounted within said receptacle, each of said contacts having first and second sides flexibly coupled at one end with said opposite end being unobstructed to form a free end for receipt of a prong of said plug;

opposed inclined surfaces mounted on said first sides;

a control member mounted between said opposed incline surfaces, said control member movable along said surfaces between a first position wherein said control member is wedged between said inclined surfaces forcing said first side in the direction of said second side to urge said free ends to a closed position and a second position wherein said first sides are unobstructed by said control member permitting said free ends to open for receipt of said prongs of said plug;

biasing means normally biasing said control member to said first position whereby said contacts are normally closed.

7. The outlet of claim 6, further including a blocking means positioned between each of said first and second sides, said blocking means being pivotally mounted for movement between a first position wherein said blocking means is adjacent said free end to prevent insertion into said free end and a second position wherein said blocking means is pivoted away from said free ends to permit insertion at said free end.

8. The outlet of claim 7, wherein said blocking means is normally biased to said first position.

9. The outlet of claim 6, wherein each of said sides includes a longitudinally extending ridge to facilitate the closing of said free end when said control member is in said first position.

10. The outlet of claim 8, wherein each of said sides includes a longitudinally extending ridge for facilitating the pivoting of said blocking means away from said free end thereby facilitating the closing of said free ends.

11. An electrical outlet having at least one receptacle for receipt of an electrical plug, said outlet comprising:

a pair of spaced electrical contacts mounted within said receptacle, each of said contacts being defined by a generally u-shaped electrically conductive member having elongated sides and an end to receive one prong of said electrical plug with adjoining sides of said contacts having inclined surfaces increasing in height along the length of said sides between low and high points;

an actuator arm mounted between said adjoining sides moveable along said inclined surfaces between a first position wherein said actuator arm is wedged between said inclined surfaces at said high points of said surfaces forcing said elongated sides of said contacts together to close said contacts and prevent receipt of said electrical plug or if said plug has been inserted to resist removal of said plug and a second position wherein said actuator arm is between said low points to open said ends of said contacts for receipt of said prongs of said plug or for removal of said plug;

biasing means normally biasing said actuator arm to said first position whereby said contacts are normally closed preventing insertion of said plug or if said plug is inserted, resisting removal thereof.

12. The outlet of claim 11, further including a blocking means positioned between said elongated sides of each said contact, said blocking means being pivotally mounted for movement between a first position wherein said blocking means is adjacent said end to prevent insertion into said end and a second position wherein said blocking means is pivoted away from said end to permit insertion into said end.

13. The outlet of claim 12, wherein said blocking means is normally biased to said first position.

14. The outlet of claim 13, wherein each of said elongated sides includes a longitudinally extending ridge to facilitate the closing of said ends when said actuator arm is in said first position.

15. The outlet of claim 13, wherein each of said elongated sides includes a longitudinally extending ridge for facilitating the pivoting of said blocking means away from said ends and for facilitating the closing of said ends.

* * * * *